United States Patent [19]

Hallett et al.

[11] Patent Number: 5,060,575

[45] Date of Patent: Oct. 29, 1991

[54] TURN CONTROLLER FOR SUSPENDED PERSONAL TRANSPORT VEHICLE

[75] Inventors: Stanley J. Hallett, Chicago, Ill.; Thomas E. Hallett, Melbourne Beach, Fla.

[73] Assignee: Pathfinder Systems, Inc., Chicago, Ill.

[21] Appl. No.: 540,114

[22] Filed: Jun. 19, 1990

[51] Int. Cl.[5] ..... E01B 7/04

[52] U.S. Cl. ..... 104/130; 104/304

[58] Field of Search ..... 104/130, 93, 89, 295, 104/304, 305, 94, 111, 139, 140

[56] References Cited

U.S. PATENT DOCUMENTS

| | | | |
|---|---|---|---|
| 3,712,238 | 1/1973 | Colovas et al. | 104/130 |
| 3,759,187 | 9/1973 | Gayot | 104/130 |
| 3,946,974 | 3/1976 | Stiefel et al. | 104/130 |
| 4,015,539 | 4/1977 | Hamada | 104/130 |
| 4,203,369 | 5/1980 | Perrott | 104/130 |
| 4,214,535 | 7/1980 | Gerhard | 104/130 |
| 4,290,367 | 9/1981 | Brause et al. | 104/130 |

FOREIGN PATENT DOCUMENTS

| | | | |
|---|---|---|---|
| 2617780 | 4/1976 | Fed. Rep. of Germany | 104/130 |
| 0057715 | 5/1979 | Japan | 104/130 |

*Primary Examiner*—Robert J. Oberleitner
*Assistant Examiner*—Mark T. Le
*Attorney, Agent, or Firm*—Longacre & White

[57] ABSTRACT

An overhead suspended track mounted vehicle guidance system having an active on board station selection system and a passive non switching track. The slotted track includes an interiorly depending turn vane for guiding the guide wheel of the vehicle mounted guidance system. The system includes provision for fail safe operation wherein a mechanical interlock automatically assures next station selection in the event of guidance system failure.

3 Claims, 2 Drawing Sheets

FIG. 5
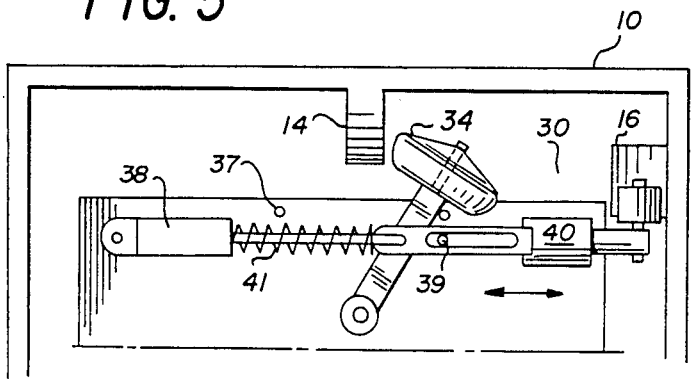
FIG. 6
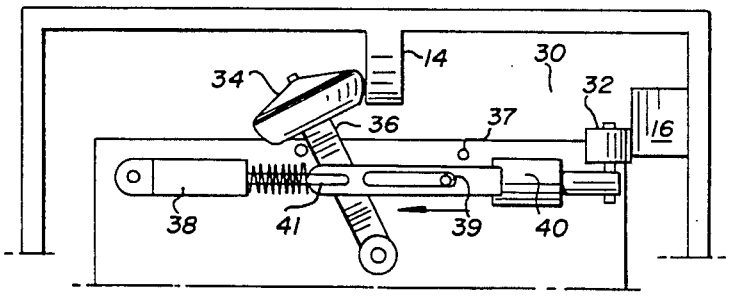
FIG. 7
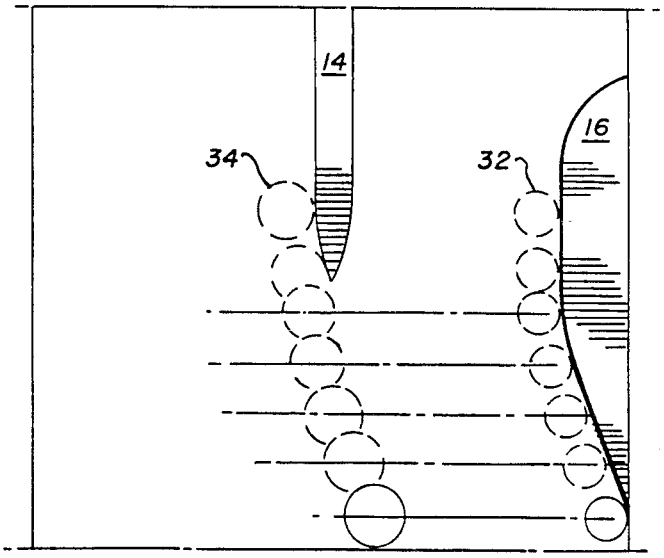
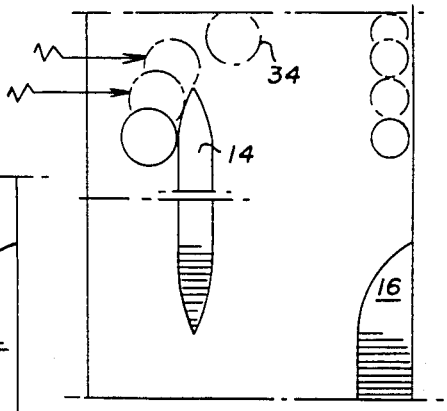
FIG. 8

TURN CONTROLLER FOR SUSPENDED PERSONAL TRANSPORT VEHICLE

The invention is directed to the field of directional control systems for track guided vehicles. More particularly, the present invention is directed to a turn control system for overhead suspended track mounted personal transit vehicles, wherein the track is a passive guide element.

BACKGROUND OF THE INVENTION

In the broad field of people transit systems, there exists many and varied types of transportation available. Transportation has evolved over the years from horse to carriage to mechanized transports of many kinds. One category of the many available systems could be those which are confined to operate via a track, and more particularly those operated from an overhead track. Examples of such transportation systems can be found in U.S. Pat. Nos. 4,841,871 and 3,118,392. In all of the track mounted vehicles, the vehicles are guided place to place by interaction between the track and vehicle in combination with switching systems. The switching has become automated over the years to the extent that much of the track operation is remotely controlled from a central location. While this system is efficient in terms of providing a coordinated use of track and vehicles, is does not lend itself to flexibility, ease of construction or maintenance, or low cost. As such, the design and installation of track systems is always accompanied by great deliberation, fund raising, and much politicking for and against the system.

The present invention proposes an overhead track guidance system for personal transit vehicles wherein the track is a standard assembly which can be inexpensively erected, maintained, and flexibly replaced, re-erected, etc. The primary virtue of the present system being the passive design of the track with respect to switching and guidance of the vehicle. The track merely supports the vehicle while the station selection function, station turn in and departure, and fail safe default operations are executed by the guidance system on board the vehicle. Hence the track does not have costly monitoring features for switching, and the associated drawbacks of switch failure, ie, sections of track rendered unusable until maintenance is performed. Further, owing to the passive operation of the track with respect to vehicle guidance, the vehicles do not require a large space between them during system operation to allow for track switching for following vehicles.

SUMMARY OF THE INVENTION

The track according to the present invention comprises an overhead slotted guide way, suspended on poles or other appropriate structure. The track includes the necessary branching slots and continuing sections for station access and bypass. The track also includes a guide vane which extends from the portion of the guide way opposite the slot and interacts with a steering element of the vehicle mounted guidance system.

The personal transport vehicle according to the present invention includes a mechanized guidance system which cooperates with the track to direct the vehicle. The on board system determines station selection, turn in, and departure. The on board system also provides for fail safe station turn in when an on board system failure occurs. The faulty vehicle is then merely routed for maintenance, while the remaining vehicles continue to operate on the track to the necessary capacity.

These and other objects of the present invention will become apparent to those of ordinary skill in the suspended vehicle art upon a reading of the following specification and claims which are a part thereof.

BRIEF DESCRIPTION OF THE DRAWINGS

FIG. 5 shows an enlarged end view of the interaction between the track and bogey mounted vehicle guidance system of the present invention with the guide wheel biased to its rightmost position;

FIG. 6 is another enlarged end component view of the turn control system mounted on a personal transport vehicle according to the present invention with the guide wheel drawn to its leftmost position;

FIG. 7 is a top plan view of a track section according to the present invention including a central guide vane and a default turn bumper;

FIG. 8 is a sectional elevational view of a portion of track having a turn vane according to the present invention and including a passing bogey turn control mechanism.

DETAILED DESCRIPTION OF THE PREFERRED EMBODIMENT

Figure 1:
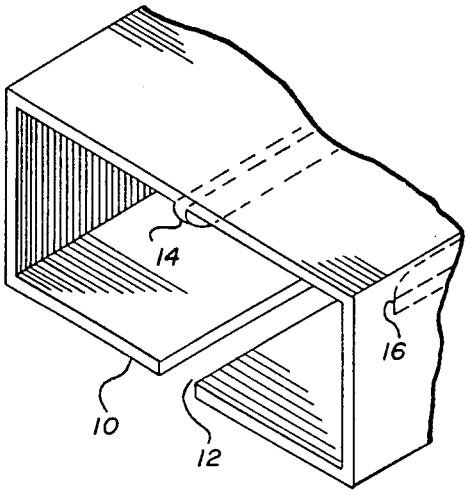
FIG. 1 shows a track portion according to the present invention including a depending turn vane from an upper portion of the guideway.
Figure 2:
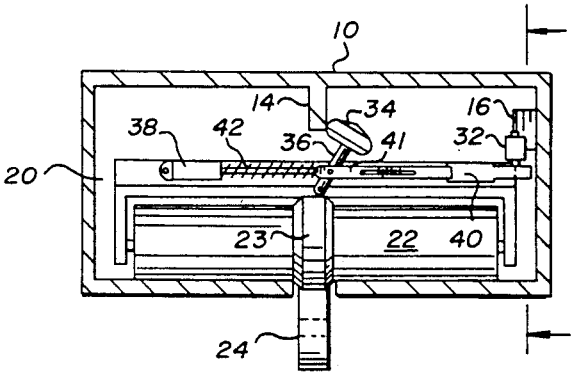
FIG. 2 shows a sectional end view of a track section according to the present invention, having a vehicle support bogey passing therein.
Figure 3:
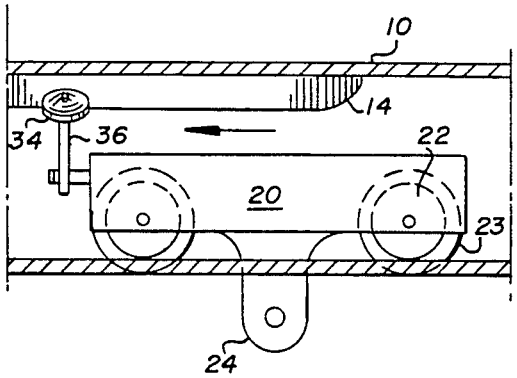
FIG. 3 shows a sectional elevational view of a track section according to the present invention, having a vehicle support bogey passing therein.

The turn control system 30 of the present invention will now be described with reference to the drawings, wherein like reference numerals are used in each figure.

The personal transport vehicle is suspended from a pair of wheeled bogeys 20 positioned forwardly and aft from a vehicle. Each bogey 20 comprises a pair of wheels 22 having a frame connected therebetween, and a vehicle suspension arm 24 extending to the vehicle downwardly through the track slot 12. Each wheel 22 is wide enough to traverse the entire breadth of the slotted guideway 10, and includes a circumferential rib 23 which engages the slot 12 and stabilizes the wheel 22 as it rolls along the guide way 10. One or both wheels 22 on the bogey 20 may be either motor or support wheels as necessary for particular load and speed requirements of the system. The motor for the wheel is contained within the wheel, and is powered by an on board power source within the vehicle.

Figure 4:
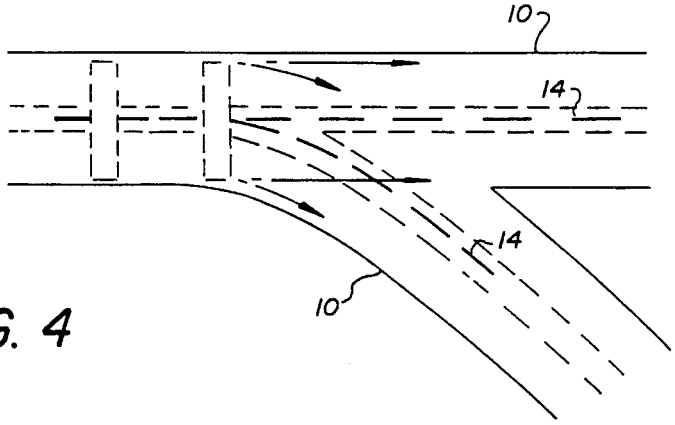
FIG. 4 shows a plan view of a branch section of track according to the present invention.

The suspended guide way 10 branches into two separate guide ways by expanding and dividing into distinct guide ways as shown in FIG. 4. The wheels 22 on the bogeys 20, owing to their breadth within the guide way 10, traverse the branching slot 12 as they either turn into or bypass a branching guide way section. In this manner, the bogey wheels 22 have continuous support as they travel through the guide way 10 and connected branches.

To guide the bogey 20 to turn or pass a branch in the guide way, a guide vane 14 depends from an upper portion of the guide way. At junctions the guide vane 14 emerges from an upper portion of the guide way and branches within the corresponding branches of the guide way 10.

Each bogey 20 is equipped with a turn control system 30. The system 30 comprises a guide wheel 34 which is suspended above the bogey 20 in an upright pivoting manner. The guide wheel 34 engages the guide way turn vane 14 as necessary to either turn into or bypass a station or, as will be described elsewhere, perform the default function to assure fail safe operation of the guidance system 30. The guide wheel 34 is mounted on a support arm 36 which enables the guide wheel to pivot to the left and right within the guide way and forward of the bogey. To assure limited travel-of the pivot support arm 36, the bogey frame is equipped with stops 37 to the left and right of the arm 36. The support arm 36 is urged left and right on the one side by a spring 42 along travel arm 41, which maintains a bias of the support arm 36 to the right, and actuator 38. A second actuator 40 is provided along travel arm 41 to move default wheel 32 along the travel arm 41 toward and away from approaching default bumpers 16. The travel arm is equipped with a slot and stop pin 39 to allow for longitudinal movement of the travel arm 41 when the default actuation of the guide wheel 34 is taking place, or when a left turn is selected.

The respective actuators 38 and 40 are controlled from within the vehicle by means of a station selection and identification system so that the vehicle is guided to the chosen destination automatically after station selection has been made. (Much in the same way a conventional elevator stops at the selected floors, an example of such a system used with a track vehicle is disclosed in U.S. Pat. No. 4,726,299, which is incorporated herein, by reference.)

As the bogey 20 approaches a turn, the guide way turn vane 14 emerges downwardly from an upper portion of the guide way 10. The guide wheel 34 either rides along, the turn vane 14 to turn the bogey 20 into the branching guide way, or rides along an opposite side of the turn vane 14 which, guides the bogey 20 past the branch. Since the guide wheel 14 is biased to the right, only motion from the secondary actuator 40 is necessary to guide the bogey past a left turn branch. The secondary actuator 40 moves the default wheel 32 along travel arm 41 and away from the default bumper 16 so that the guide wheel 34 may follow the guide vane 14 past the station. In the event that a left turn station is selected, the primary actuator 38 either moves the guide wheel 34 to the left and the turn vane 14 guides the bogey 20 into the left branch of the guide way, or the left turn bumper 16 urges the default wheel 32 to push the support arm 36 and urge the guide wheel 34 into the left turn position (see FIG. 7). Similarly, if the bogey 20 is to pass a right turn station, the actuator 38 pulls the guide wheel 34 to the left, and the bogey proceeds past the right branching guide way.

For purposes of guiding the bogey 20 in the event of an actuator (either 38 or 40) failure in the guidance system, a mechanical interlock between the guidewheel 34 and guideway 10 occurs. In the event of a left turn default, ie, the next station is a left turn branch, the guide way track 10 is provided with a left turn bumper 16 so as to urge the default wheel 32 against the rightward bias 42 of the guide wheel support arm 36 and force the guide wheel 34 to follow the turn vane along the left turn branch instead of past the branch. In the event that the next station is a right turn station, the guide wheel is already biased to this position and will automatically select the station.

The sizing of the necessary materials to make up the guide way and bogey members is a matter of design choice according to the necessary specifications of the system. For instance, in light weight uses of the system, ie, unmanned small bulk transport, inter office mail, etc, the guide way may be an extruded piece equipped with magnetic location identifiers readable by a passing bogey. The bogey can similarly be a molded article carrying necessary power requirements, and having a suitable station selecting system carried on board. (A system similar to most elevators simply adapted for the track mounted bogeys would suffice in most uses of the system.)

For heavier load and faster speed requirements, the track may be a metallic channel member, and the travelling bogeys could similarly be metal framed. The motor wheel units for propelling the vehicles may have significant horsepower, and permit the vehicles to travel at comparatively high rates of speed.

While the present invention has been described in conjunction with what is considered to be the best mode thereof, many alternatives within the scope of the present invention will occur to those of ordinary skill in this field.

We claim:

1. A turn controller system for an over head suspended rail type vehicle comprising:

slotted channel shaped track means for guiding said vehicle, said track means including a guiding slot extending along said track means and guide vane means for directing said vehicle at branches of said track means, said guide vane means extending within said channel shaped track means and located opposite said guiding slot;

a wheeled bogey for supporting and propelling said vehicle through said track means;

a guidance system for directing said bogey through said track means comprising a guide wheel, said guide wheel being pivotally connected to said bogey and being positioned left and right within said track means by at least one actuator mounted on said bogey, said guide wheel engaging said guide vane means and riding therealong, and guiding said bogey in the direction of said guide vane means;

a default wheel connected to said guide wheel which urges said guide wheel to a default left or right orientation within said track means; and said track means further comprising turn bumper means depending within said channel shaped track means to engage and urge said default wheel against said guide wheel.

2. A turn control system as in claim 1, wherein:

said wheeled bogey comprises a pair of wheels supported on a frame and said wheels are of substantially the same width as the inside of said slotted track means.

3. A turn control system as in claim 1, wherein:

said guidance system further comprises a second actuator for displacing said default wheel toward and away from said turn bumper means as said bogey passes through said track means.

* * * * *